US005832574A

United States Patent [19]

Shin

[11] Patent Number: 5,832,574

[45] Date of Patent: Nov. 10, 1998

[54] FOOTWEAR STRING END TIGHTENING ACETATE TUBE

[76] Inventor: Chungkil Shin, Ju-kong apt. #312-101, 516, Dangkam 3 dong, Jin-ku Pusan, Rep. of Korea

[21] Appl. No.: 926,887

[22] Filed: Sep. 10, 1997

[51] Int. Cl.[6] ..... A43C 9/00

[52] U.S. Cl. ..... 24/712.1; 24/715.4; 24/715.7

[58] Field of Search ..... 24/715.4, 715.6, 24/715.7, 712, 712.1, 712.4, 713, 713.1, 714.6, 300

[56] References Cited

U.S. PATENT DOCUMENTS

| | | | |
|---|---|---|---|
| 1,099,479 | 6/1914 | Wiberley | 24/715.7 |
| 1,179,191 | 4/1916 | Kempshall | 24/715.4 |
| 2,009,330 | 7/1935 | Tate | 24/713.1 |
| 2,036,482 | 4/1936 | Larson | 24/715.7 |
| 2,214,030 | 9/1940 | Pereles | 24/588 |
| 3,507,949 | 4/1970 | Campbell | 24/265 EE |
| 3,581,353 | 6/1971 | Sonntag | 24/715.4 |
| 5,619,778 | 4/1997 | Sloot | 24/715.4 |
| 5,638,589 | 6/1997 | Phillips | 24/715.4 |

*Primary Examiner*—Victor N. Sakran
*Attorney, Agent, or Firm*—Notaro & Michalos P.C.

[57] ABSTRACT

A footwear string end tightening acetate tube which is made of a transparent cellulose acetate film and is inserted to prevent both end portions of a footwear string weave from being loose, the tube including: an arbitrary advertising character or picture screen-printed on the one side or both sides of the interior of the tube by using a polyurethan two-liquid hardening ink; a solvent-resisting coating layer formed on the upper surface of the printed advertising character or picture; and a semicircular groove formed in the vicinity of the end portion of the string in a hot press manner.

1 Claim, 2 Drawing Sheets

FOOTWEAR STRING END TIGHTENING ACETATE TUBE

BACKGROUND OF THE INVENTION

1. Field of the Invention

The present invention relates to a footwear string end tightening acetate tube with which a string can be easily inserted into a footwear and a high advertising effect can be achieved. More particularly, the present invention relates to a footwear string end tightening acetate tube which has a semicircular groove which is formed on the end portion of a footwear string, to easily insert the string into predetermined holes on the footwear and has an advertising character or picture which is printed on the interior thereof, to thereby achieve a high advertising effect, more sophisticated appearance and increment of a commercial value of the product.

2. Discussion of the Prior Art

Generally, a transparent footwear string end tightening tube, which is made of a cellulose acetate film, is formed on both end portions of a footwear string 100, to thereby prevent the end portions of the string weaved from being loose.

Of course, a high-frequency bonding parting A is formed on the one side of the footwear string end tightening tube.

However, the conventional footwear string end tightening acetate tube has a simple function of preventing the weaved end portions of the footwear string from being loose. Further, since the acetate tube generally takes a form of a cylindrical shape which has no indentations, there is an inconvenience in that when a user inserts the string into predetermined holes of the footwear, he or she pulls the end portions of the string with his or her fingertip or finger nail.

SUMMARY OF THE INVENTION

An object of the present invention is to provide a footwear string end tightening acetate tube with which a string can be easily inserted into predetermined holes of a footwear by further improving a conventional footwear string end tightening acetate tube and which can print an advertising character or picture on the interior thereof, to thereby achieve a high advertising effect.

To achieve this and other objects according to the present invention, there is provided a footwear string end tightening acetate tube which is made of a transparent cellulose acetate film and is inserted to prevent both end portions of a footwear string weaved from being loose, the tube comprising: an arbitrary advertising character or picture screen-printed on the one side or both sides of the interior of the tube by using a polyurethan two-liquid hardening ink; a solvent-resisting coating layer formed on the upper surface of the printed advertising character or picture; and a semicircular groove formed in the vicinity of the end portion of the string in a hot press manner.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Hereinafter, an explanation on the construction and operation of the footwear string end tightening acetate tube embodied according to the present invention will be in detail discussed with reference to FIGS. 1 to 3.

Figure 1:
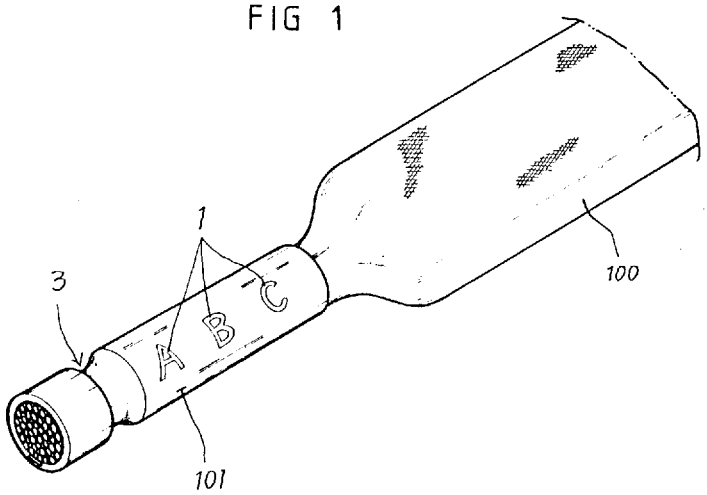
FIG. 1 is a view illustrating a use state of a footwear string end tightening acetate tube embodied according to the present invention.
Figure 2:
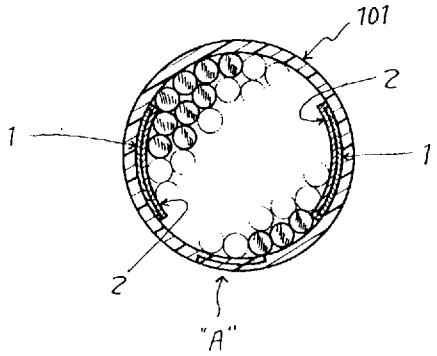
FIGS. 2 and 3 are sectional views illustrating a footwear string end tightening acetate tube embodied according to the present invention.
Figure 3:
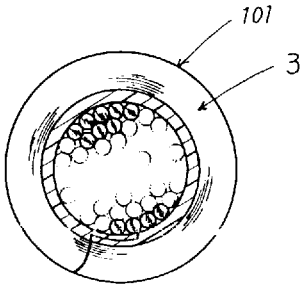

Referring to FIGS. 1 to 3, there is provided a footwear string end tightening acetate tube 101 which is made of a transparent cellulose acetate film and is inserted to prevent both end portions of a footwear string 100 weaved from being loose. The footwear string end tightening acetate tube 101 includes: an arbitrary advertising character or picture 1 screen-printed on the one side or both sides of the interior of the tube 101 by using a polyurethan two-liquid hardening ink; a solvent-resisting coating layer 2 formed on the upper surface of the printed advertising character or picture 1; and a semicircular groove 3 formed in the vicinity of the end portion of the string 100 in a hot press manner. The formation of the advertising character or picture 1 can have a high advertising effect, and the formation of the semicircular groove 3 allows the footwear string end tightening acetate tube 101 to be easily pulled by a user's fingertip or nail, when he inserts the string 100 into predetermined holes of the footwear. Under the above construction, the footwear string end tightening acetate tube according to the present invention has a primary function of preventing the weaved end portions of the footwear string 100 from being loose. Further, the footwear string end tightening acetate tube according to the present invention can achieve an excellent advertising effect through the advertising character or picture 1 which is printed on the interior of the acetate tube 101.

Of course, the advertising character or picture I may be replaced with various designs or marks, which are printed with a blank/white color or various colors.

The polyurethan two-liquid hardening ink used to form the advertising character or picture exhibits strong penetrating force and bonding force against the cellulose acetate film. Meanwhile, in the case where the footwear string 100 is washed or is wet by rainwater, or although other materials (for example, contaminated wastewater, oil, acid material, alkaline material and so on) are penetrated through the interior of the acetate tube 101, since the solvent-resisting coating layer 2 is formed to protect the advertising character or picture 1 on the upper surface thereof, the advertising character or picture 1 is not any affected from the water or other materials and maintains its own durability constantly. Accordingly, the printed state of the advertising character or picture 1 is not distorted or discolored.

Accordingly, the footwear string end tightening acetate tube 101 according to the present invention can exhibit the excellent advertising effect with the advertising character or picture 1 until the footwear string 100 is worn and is thus exchanged into a new string.

The formation of the semicircular groove 3 in the vicinity of the end portion of the string 100, in a hot press manner, allows the footwear string end tightening acetate tube 101 to be easily pulled by a user's fingertip or nail within a rapid time period, when he inserts the string 100 into the predetermined holes of the footwear.

As apparent from the foregoing, there is provided a footwear string end tightening acetate tube with which a string can be easily inserted into predetermined holes of a footwear by further improving a conventional footwear string end tightening acetate tube and which can print an advertising character or picture on the interior thereof, to thereby achieve a high advertising effect.

Although a preferred form of the invention has been described, it will be understood by those skilled in the field that variations therefrom, and analogous uses, are within the knowledge of those skilled in the art. Accordingly, it is intended that the scope of the invention be defined, not by the scope of the foregoing description, but rather by the scope of the claims as interpreted in view of the pertinent prior art.

What is claims is:

1. A footwear string end tightening tube in combination with a woven footwear string having an end, comprising:

a tube of transparent cellulose acetate film engaged around the end of the woven footwear string, the tube having an inner surface and an outer surface;

an arbitrary advertising character or picture screen printed on the inner surface of the tube, the character or picture being screen printed using polyurethane two liquid hardening ink;

a solvent-resistance coating layer on the inner surface of the tube covering the screen printed character or picture; and a semi-circular groove defined around an outer surface of the tube near an end of the woven footwear string defining a recess which can be engaged by fingers of a user for helping to thread the string to footwear.

* * * * *